Figure 1:
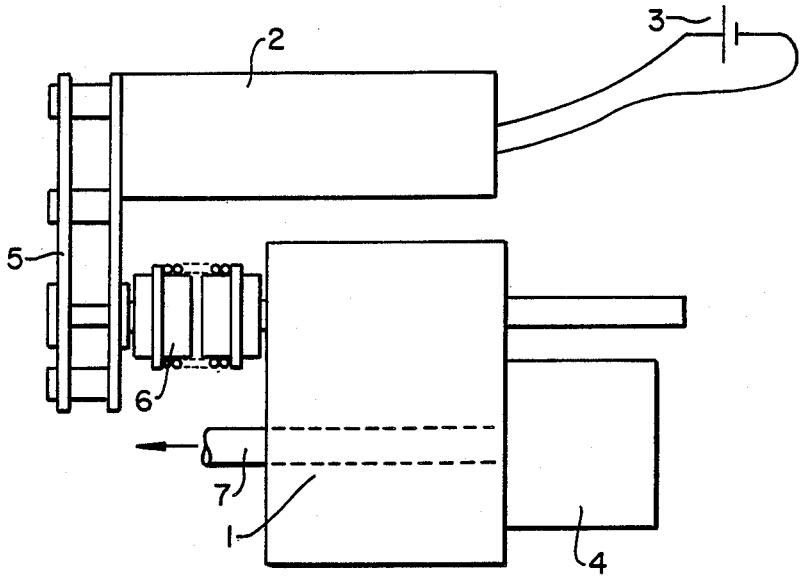

United States Patent [19]

Ogami

[11] Patent Number: 4,952,124

[45] Date of Patent: Aug. 28, 1990

[54] MEDICINE INJECTOR AND METHOD OF USING SAME

[75] Inventor: Mitsuji Ogami, Nara, Japan

[73] Assignee: Sharp Kabushiki Kaisha, Osaka, Japan

[21] Appl. No.: 843,067

[22] Filed: Mar. 24, 1986

[30] Foreign Application Priority Data

Apr. 1, 1985 [JP] Japan ..... 60-69369

[51] Int. Cl.[5] ..... F04B 43/12

[52] U.S. Cl. ..... 417/474; 604/151; 604/153; 128/DIG. 12

[58] Field of Search ..... 417/474, 475; 604/131, 604/151, 153; 128/DIG. 12

[56] References Cited

U.S. PATENT DOCUMENTS 4,482,347 11/1984 Borsanyi ..... 417/474
4,653,987 3/1987 Tsuji et al. ..... 128/DIG. 12
4,867,744 9/1989 Borsanyi ..... 604/153
4,869,646 9/1989 Gordon et al. ..... 417/474 X

FOREIGN PATENT DOCUMENTS 58-007253 1/1983 Japan .
60-059490 4/1985 Japan .

*Primary Examiner*—Leonard E. Smith
*Assistant Examiner*—Eugene L. Szczecina, Jr.
*Attorney, Agent, or Firm*—Flehr, Hohbach, Test, Albritton & Herbert

[57] ABSTRACT

A medicine injector includes a finger pump which comprises an injection tube containing a liquid medicine and a plurality of fingers adapted to move in a specified sequence to compress this tube. The widths of these fingers are effectively varied by simultaneously compressing the tube with specified two or more of these fingers. This has the effect of increasing the amount of liquid which can be ejected out of the tube and to minimize the effects of a backflow.

**6*Claims, 3 Drawing Sheets**

MEDICINE INJECTOR AND METHOD OF USING SAME

This invention relates to a medicine injector having a finger pump which serves to inject medicine by compressing an injection tube with a plurality of fingers adapted to move with respect to the tube in a specified sequence. This invention relates also to a method of using such an injector.

Finger pumps for injection of medicine and automatic titration have been in use. For example, the injector disclosed in Japanese Patent Publication Tokkai No. 58-7253 is used for the injection of small amounts of medicine such as injection of insulin to a diabetic and a liquid pumping apparatus disclosed in Japanese Patent Publication Tokkai No. 58-165868 is used for medical purposes and in particular for automatic titration.

The injector of Japanese Patent Publication No. 58-7253, however, can not be made sufficiently compact because each of its fingers is supported at one end and a plate spring is used to connect it to a supporting member such that the total number of parts to be assembled is comparatively large. Moreover, there is the problem of low torque characteristics caused by the resistive forces of these springs when it is operated by a single battery. In addition, side fingers are made thin and are adapted to function as valves, and center fingers are made broader and are adapted to function as pumps. Since a plurality of types of fingers with different widths are required, the number of component types increases and this tends to increase the production cost. Thus, it is not easy to provide a multi-purpose pump mechanism capable of appropriately changing the amount of liquid which is ejected.

The liquid pumping apparatus of Japanese Patent Application No. 58-165868, on the other hand, is composed of a pump mechanism and a mechanism for changing internal capacity of the flow route on the downstream side of an injection tube. Thus, it cannot be made compact, back flows are likely to be caused in the pump mechanism and the ejected amount of medicine is likely to vary by the fluctuations in the diameter and thickness of the tube as well as in the dimensional accuracy (gap between the fingers and a receiving plate).

It is therefore an object of the present invention in view of the disadvantages of the conventional apparatus described above to provide a medicine injector with a small number of component parts and a method of using the same.

It is another object of the present invention to provide a medicine injector which is compact and of low torque.

It is a further object of the present invention to provide a medicine injector which is portable and can be operated by a battery.

The above and other objects of the present invention are attained by providing a medicine injector with a finger pump which comprises an elastic tube containing a liquid medicine and a plurality of fingers adapted to move in a specified sequence to compress this tube. The width of these fingers are effectively varied by simultaneously compressing the tube with specified two or more of these fingers such that the amount of liquid ejected out of the tube can be increased.

Figure 2A:
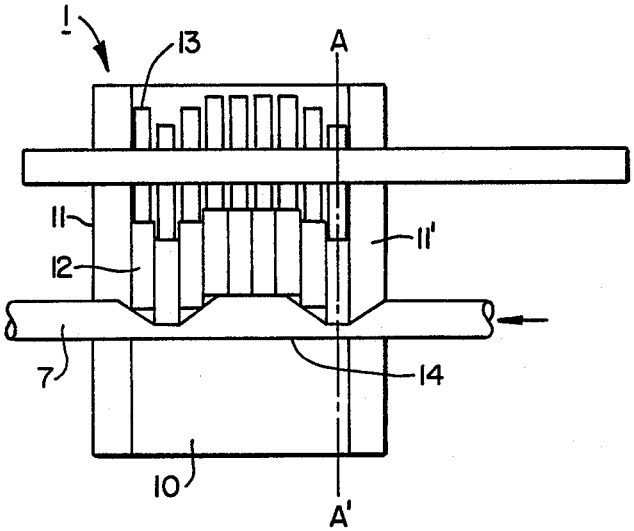
Figure 2B:
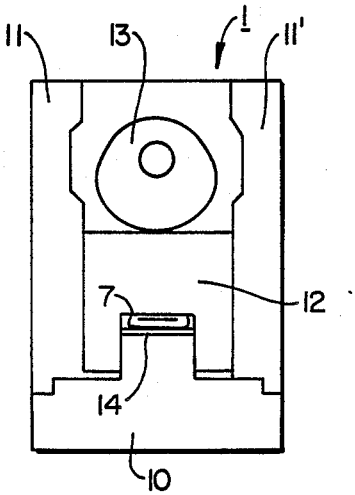
Figure 4:
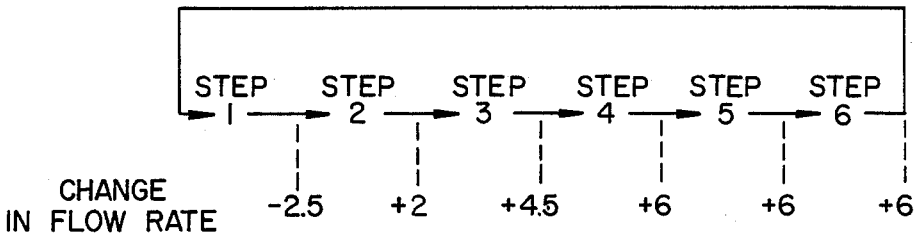
Figure 3:
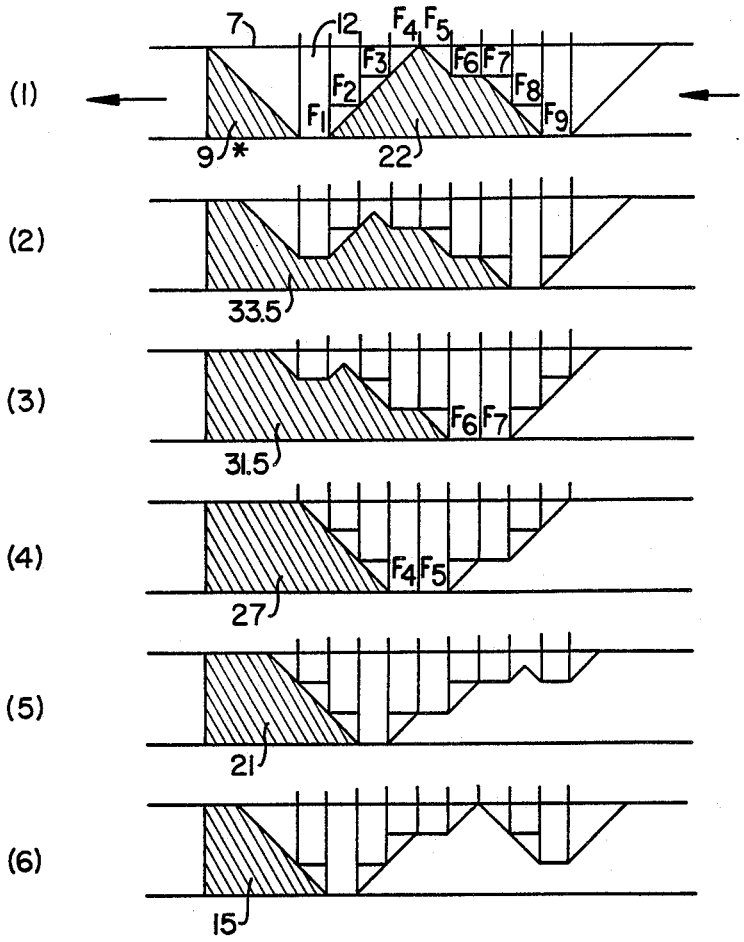
Figure 5A:
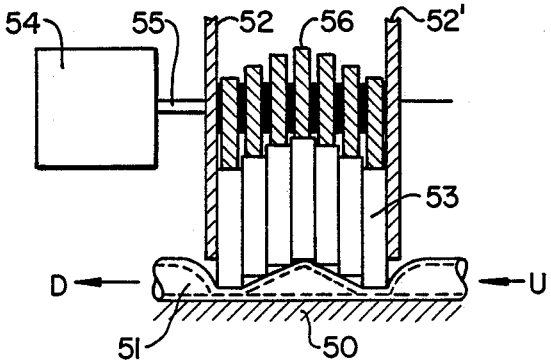
Figure 5B:
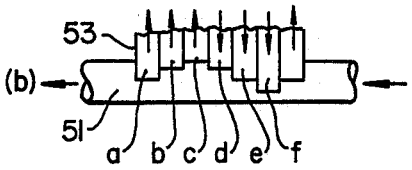
Figure 6:
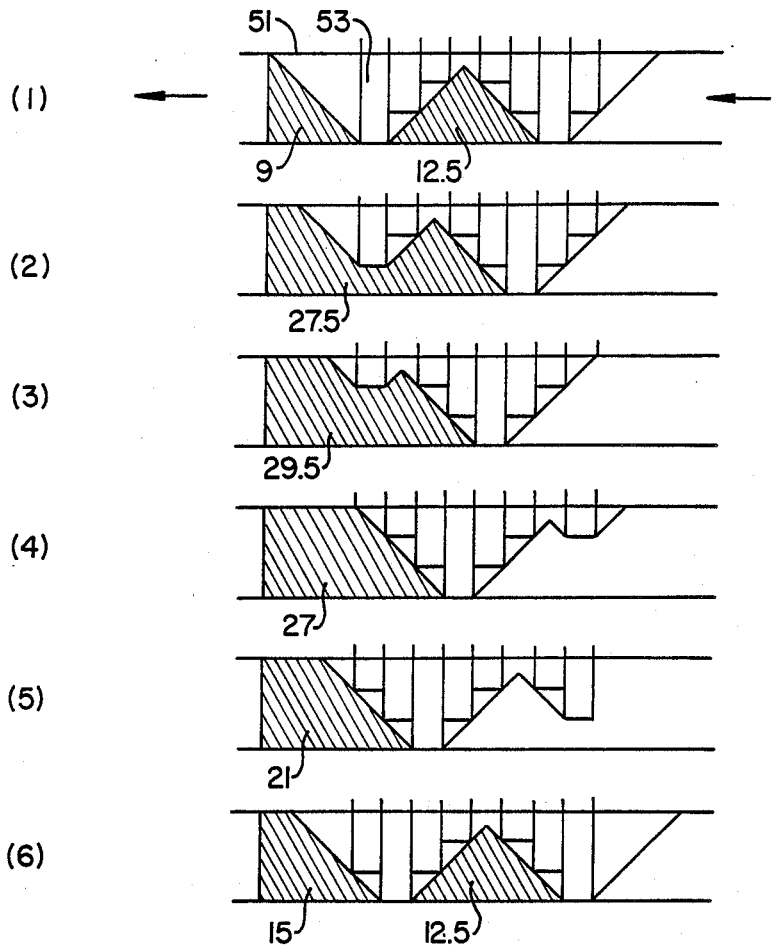
Figure 7:
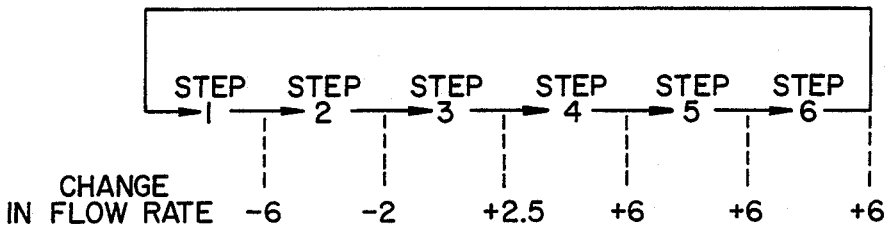

The accompanying drawings, which are incorporated in and form a part of the specification, illustrate an embodiment of the present invention and, together with the description, serve to explain the principles of the invention. In the drawings:

FIG. 1 is a structural diagram of a medicine injector according to an embodiment of the present invention, FIG. 2 shows the details of the finger pump shown in FIG. 1, FIG. 3 is a diagram showing the flow of liquid inside the ejection tube of FIG. 2, FIG. 4 is a diagram showing the variation in the flow rate in the flow shown in FIG. 3, FIG. 5 is a structural diagram of a prior art finger pump, and FIG. 6 is a diagram showing the flow of liquid in the tube of FIG. 2, and FIG. 7 is a diagram showing the change in flow rate of FIG. 6.

In FIG. 1, there is shown a small portable medicine injector usable conveniently, for example, as an insulin injector which is operable by a battery and of a low torque. It is provided within its housing (not shown) with a finger pump 1, a motor 2, a battery 3 and also a container 4 for storing used medicine to be discarded. The motor 2 is adapted to be operable by the battery 3 and the rotary driving force of the motor 2 drives cams inside the finger pump 1 through a gear head 5 and a coupler 6. Numeral 3 may represent, for example, a single dry cell of output voltage 1.8 volt. Numeral 7 indicates an injection tube to be described below FIG. 2 shows details of the finger pump of FIG. 1, FIG. 2(*a*) being a sectional view and FIG. 2(*b*) being the view along the line A-A', of FIG. 2(*a*). As shown, the finger pump 1 includes within itself a receiving plate 10, finger guides 11 and 11', a plurality of fingers 12 (nine in FIG. 2(*a*)) disposed in the finger guides 11 and 11' and moved by the actions of cams driven by a rotating driving means such as the aforementioned motor 2 and eccentric cams 13 (nine in FIG. 2(*a*)) secured to a shaft rotated by the motor 2. An elastic tube 7 for ejecting medicine contained therein is disposed between the fingers 12 and the receiving plate 10. The fingers 12 and the eccentric cams 13 are made of a light material such as plastic. The finger guides 11 and 11' are of a material with low friction such as aluminum and made sufficiently long in order to improve the mobility of the fingers 12. The ejection tube 7 is made of an elastic material such as silicone rubber so as to give itself a self-restoring force and to be able to easily push up the fingers. An elastic spacer 14 is further provided between the tube 7 and the receiving plate 10. A silicone rubber sheet may be used as the spacer 14, which serves to absorb the fluctuations in the gap between the individual fingers and the tube, and to thereby increase the amount of medicine which is ejected.

Thus, a finger pump of this invention is light and can provide an apparatus of a low torque which can be driven even by a single dry cell.

Before the mechanism for the operation of a finger pump according to the present invention is explained, the problems associated with conventional devices will be described.

As shown in FIG. 5(*a*), a prior art finger pump comprises a receiving plate 50, an injection tube 51 filled with a liquid medicine, finger guides 52 and 52', a plurality of fingers 53 (seven in FIG. 5(*a*)) disposed inside the finger guides 52 and 52', a shaft 55 rotated by a motor 54 and eccentric cams 56 secured to the shaft 55 such that the individual fingers 53 will be moved by these eccentric cams 56. The medicine is pushed inside the tube 51 from its upstream side U to the downstream side D.

With a prior art finger pump, however, there can be an occurrence of backflow as shown in FIG. 5(*b*). The motions of the fingers depicted in FIG. 5(*b*) show that the fingers b and c are released simultaneously as the finger a on the downstream side is released. This will cause the fingers d, e and f to move in the reverse direction, or in such a direction as to compress the finger, but liquid transmission will not take place because the effects of their movements are cancelled out by those of the fingers a, b and c.

Thus, a backflow of medicine results by the releasing of the finger a. When medicine is being injected into a patient's body, for example, the backflow may cause the patient's blood to become sucked into the pump.

The mechanism of liquid transmission by a prior art finger pump is illustrated in FIG. 6 where (1)–(6) each indicate a step. FIG. 6 relates to a pump with eight fingers, one of which is moved for every 1/6-turn of the shaft resulting in the compression of the tube. The numbers in FIG. 6 each indicate the volume of medicine inside the tube 51 in arbitrary units. FIG. 7 shows the change in flow rate in each step of FIG. 6. The plus symbol indicates that medicine is flowing in the normal direction. The minus symbol indicates a backflow. In the example of FIG. 7, the flow rate changes by −6 from Step (1) to Step (2), and this means a backflow. A reduction of −8 is seen to take place between Step (1) and Step (3). This reduction is cancelled out by the forward flow from Step (3) to Step (5). This means that medicine is supplied in the normal direction only from Step (5) to Step (6) and from Step (6) to Step (1). In summary, there is no supply of medicine for a period of about ⅔ of each cycle. In other words, the problems with the prior art finger pump include inability to prevent backflow and inability to transmit a large amount of medicine without increasing the power supplied to the pump.

The present invention eliminates the aforementioned problems of prior art finger pumps. An example of mechanism by which medicine is transmitted according to the present invention is shown in FIG. 3. FIG. 4 shows the associated changes in flow rate. This example relates to a finger pump with nine fingers and nine cams of the type described above such that one of the fingers is moved to compress the tube for every 1/6-turn of the shaft. In FIG. 3, $F_1$–$F_9$ represent the nine fingers, (1)–(6) each represent a step, and the motions of the fingers and the change in flow rate inside the tube for each step are also shown. The numbers each indicate the volume of medicine inside the tube such that a comparison with FIG. 6 can be made easily. In FIG. 4, the plus symbol again indicates that medicine is being transmitted in the normal direction and the minus symbol indicates a backflow.

The characteristics of the present invention are that fingers of the same shape are used and that the tube is compressed simultaneously by two or more specified fingers ($F_6$ and $F_7$ in Step (3) and $F_4$ and $F_5$ in Step (4)) by cam operations such that the finger width is effectively changed to appropriately alter the amount of medicine ejected from the tube. In other words, combinations are appropriately selected out of the plurality of fingers to conveniently change the amount of medicine ejected. Changes in flow rate shown in FIG. 4 indicate that there is a backflow from Step (1) to Step (2) but the amount of this backflow is about 1.4 as compared to the case described above. Although no medicine is transmitted during the period between Step (1) and Step (3), this period is only one-third of a cycle. This means a great improvement in the amount of medicine that is transmitted over the prior art situation. A larger amount of medicine can thus be transmitted without increasing power consumption and this invention is particularly useful in the case of a small apparatus for liquid transmission operated by a battery.

The foregoing description of a preferred embodiment of the present invention has been presented for purposes of illustration and description. It is not intended to be exhaustive or to limit the invention to the precise form disclosed, and obviously many modifications and variations are possible in light of the above teaching. For example, the number of fingers in the pump is not a determining factor for the scope of this invention. Such modifications and variations which may be apparent to a person skilled in the art are intended to be within the scope of this invention.

What is claimed is:

1. A medicine injector with a finger pump which comprises an ejection tube containing a liquid and a plurality of fingers adapted to move in a specified sequence to compress said tube, said medicine injector comprising a first means for effectively varying the widths of said fingers by simultaneously compressing said tube with specified two or more of said plurality of fingers, and a second means for controlling the amount of liquid ejected out of said tube by said first means.

2. The medicine injector of claim 1 wherein said tube is made of an elastic material.

3. A method of operating a medicine injector with a finger pump which comprises an ejection tube containing a liquid and a plurality of fingers adapted to move in a specified sequence to compress said tube, said method comprising the step of effectively varying the widths of said fingers by simultaneously compressing said tube with specified two or more of said plurality of fingers such that the amount of liquid ejected out of said tube is increased.

4. The method of claim 3 wherein said finger pump further comprises a plate, finger guides serving to guide the motions of said fingers and a plastic spacer disposed between said tube and said plate.

5. The method of claim 3 wherein said finger pump further comprises cams serving to move said fingers.

6. The method of claim 5 further comprising the step of rotating said cams by a motor to move said fingers.

* * * * *